US005263338A

United States Patent [19]

Banks

[11] Patent Number: 5,263,338

[45] Date of Patent: Nov. 23, 1993

[54] ENVIRONMENTAL CRUSHER COOLER

[76] Inventor: Jim Banks, 1195 Buchman Rd., Fremont, Ohio 43420

[21] Appl. No.: 871,291

[22] Filed: Apr. 20, 1992

[51] Int. Cl.[5] ..... F25D 23/12

[52] U.S. Cl. ..... 62/331; 62/457.7; 100/102; 100/902; 220/908

[58] Field of Search ..... 100/92, 102, 902; 62/457.4, 457.5, 457.7, 331; 220/908

[56] References Cited

U.S. PATENT DOCUMENTS

| | | | |
|---|---|---|---|
| 2,354,349 | 7/1944 | Polsen et al. | 100/4 |
| 2,493,193 | 1/1950 | Hait | 225/21 |
| 3,863,563 | 2/1975 | Popeil | 232/43.2 |
| 4,188,875 | 2/1980 | Fabbri et al. | 100/DIG. 2 |
| 4,570,536 | 2/1986 | Dodd | 100/102 X |
| 4,899,904 | 2/1990 | Dooley et al. | 62/457.5 X |
| 5,072,852 | 12/1991 | Smith et al. | 100/902 X |

*Primary Examiner*—William E. Tapolcai
*Attorney, Agent, or Firm*—Jerry Semer

[57] ABSTRACT

The invention is basically a cooler that has been designed to eliminate the problems of what to do with the beer, pop or other beverage cans after they are empty. In the preferred embodiment of the invention an individual who has drank his beverage can from the cooler section of the invention just places his can in the crusher section of the invention and closes the lid. This crushes the can which falls with the help of gravity into a bin for storages. The bin can be emptied later so the individual can dispose of his can in an environmentally sound way. The invention has a cooler section which is a thermally insulated box like structure with a thermally insulated lid. Integrally attached to the cooler section is a can crusher section which is rectangular with a semi-circular bottom. The section has a ram that is attached to the lid of the can crusher section such that when the lid is closed the ram crushes the can against the end of the can crusher section. When the can has been crushed, the can drops into a bin also integrally attached to the can crusher section and the cooler section. This bin has a door for removing the crushed cans.

13 Claims, 2 Drawing Sheets

ENVIRONMENTAL CRUSHER COOLER

FIELD OF THE INVENTION

The invention relates to a cooler and more particularly to an improved cooler that helps with waste disposal by crushing cans after use and storing the crushed cans.

BACKGROUND OF THE INVENTION

One of the major problems that humans face at the end of the twentieth century is the disposal of litter. One of the big contributor to this problem are beer, pop or other beverage cans. One of the objects of this invention is to create a cooler that makes it easier to dispose of pop, beer, or other beverage cans.

Up to this time in history coolers or ice chests have been basically designed to keep the contents within them either hot or cold. The basic ice chest is a box like structure with insulation around the sides, bottom and lid. The users of the coolers usually place pop, beer or other items they wish to keep cool along with ice in the cooler. A individual usually uses a cooler on boating trips, poolside picnics, sporting outing, fishing, or hunting. In these situations once one has used a can of pop, beer, or other beverage from within the cooler there is usually no place to dispose of the can in an environmentally sound matter. Thus, the inventor has designed his invention to make it easier for individuals using the cooler to properly dispose of their cans of pop, beer or other beverages in an environmentally sound matter. Further, to carry these cans of pop or beer back to a suitable disposable site is difficult due to the volume of the pop and beer cans. Thus, it is a further objective of the invention to lessen the volume of the pop, beer or other beverage cans for easier storage and disposal.

The features that achieve these objectives are that the inventor has attached a can crusher and a storage bin to the cooler. The advantage of this design is that an individual once through with his pop cans can easily place the can in the crusher and close the crusher's lid. This is all that is needed to be done to store the can in a crushed condition until the individual has found an environmentally sound way to dispose of the crushed cans. This makes it easy for an individual to dispose of the cans of pop, beer or other beverages with out littering the environment. Further it achieves this goal with a compact easy to use unit.

SUMMARY OF THE INVENTION

The invention is basically a cooler that has been designed to eliminate the problems of what to do with the beer, pop or other beverage cans after they are empty. In the preferred embodiment of the invention an individual who has drunk his beverage can from the cooler section of the invention just places his can in the crusher section of the invention and closes the lid. This crushes the can which falls with the help of gravity into a bin for storage. The bin can be emptied later so the individual can dispose of his can in an environmentally sound way. The invention has a cooler section which is a thermally insulated box like structure with a thermally insulated lid. Integrally attached to the cooler section is a can crusher section which is rectangular with a semi-circular bottom. The section has a ram that is attached to the lid of the can crusher section such that when the lid is closed the ram crushes the can against the end of the can crusher section. When the can has been crushed, the can drops into a bin also integrally attached to the can crusher section and the cooler section. This bin has a door for removing the crushed cans.

A BRIEF DESCRIPTION OF THE DRAWINGS

DETAILED DESCRIPTION OF THE PREFERRED EMBODIMENT

Figure 1:
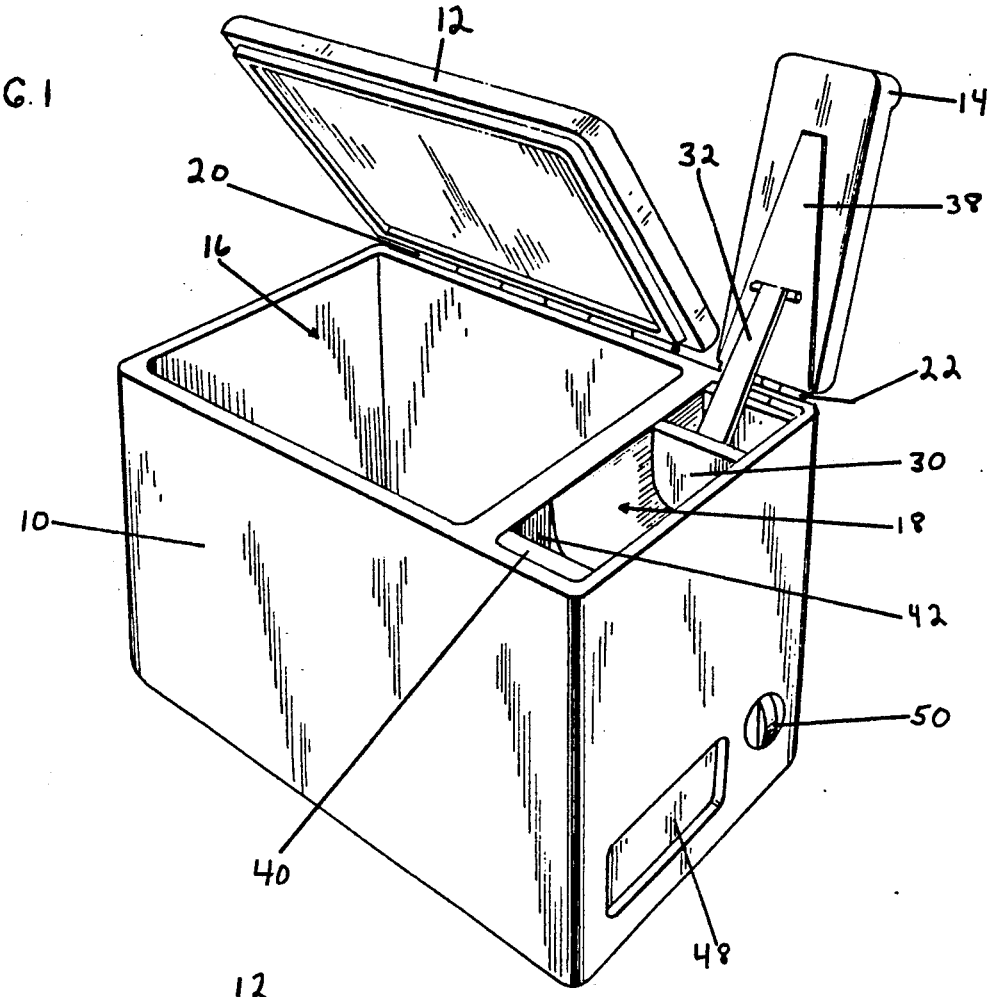
FIG. 1 is a perspective view of the invention with the lid for the cooler and the lid for the can crusher open.

The invention contains and outer shell 10 that in the preferred embodiment is box like. However, the outer shell could take other shapes that are known in the art for coolers. The outer shell 10 is open at the top. The outer shell has two lids 12 and 14. Lid 12 fits over the cooler section 16 of the invention. Lid 14 fits over and is an integral part of the can crusher section 18 of the invention. Lids 12 and 14 are rotatably attached to the outer shell 10 by hinges 20 and 22 in the preferred embodiment. The lids 12 and 14 could be attached by other means known in the art for rotatably attaching lids to shells.

Figure 2:
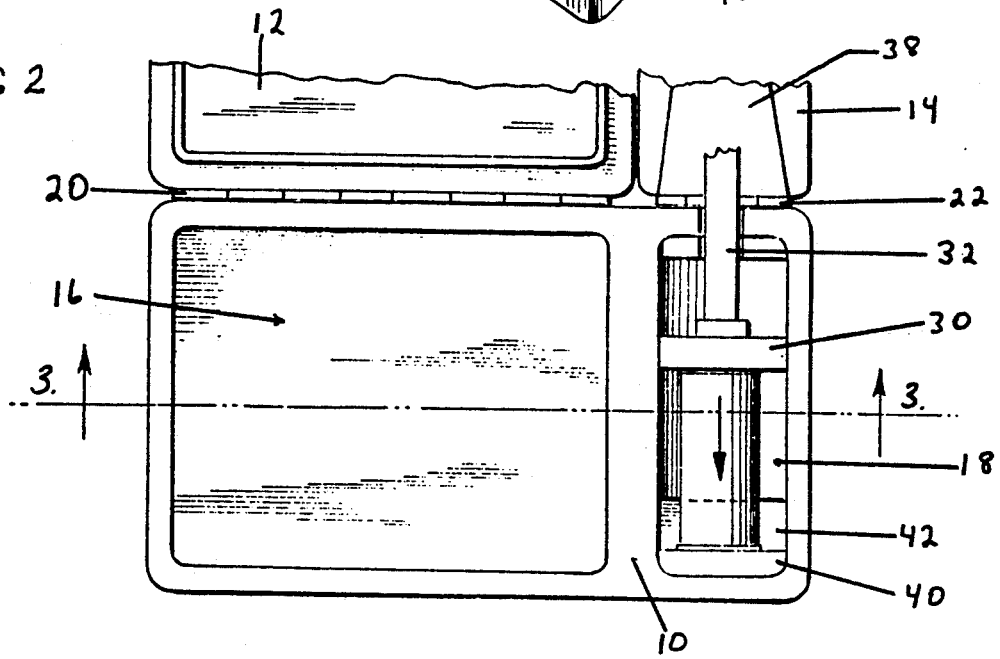
FIG. 2 is a top view of the invention with the lid for the cooler and the lid for the can crusher open.

FIG. 2 is a top view of the invention with the lids open. The cooler section 16 of the invention is a large opening with sides and a bottom. The cooler section 16 is designed for the storage of ice, pop, beer and other beverage cans.

Figure 3:
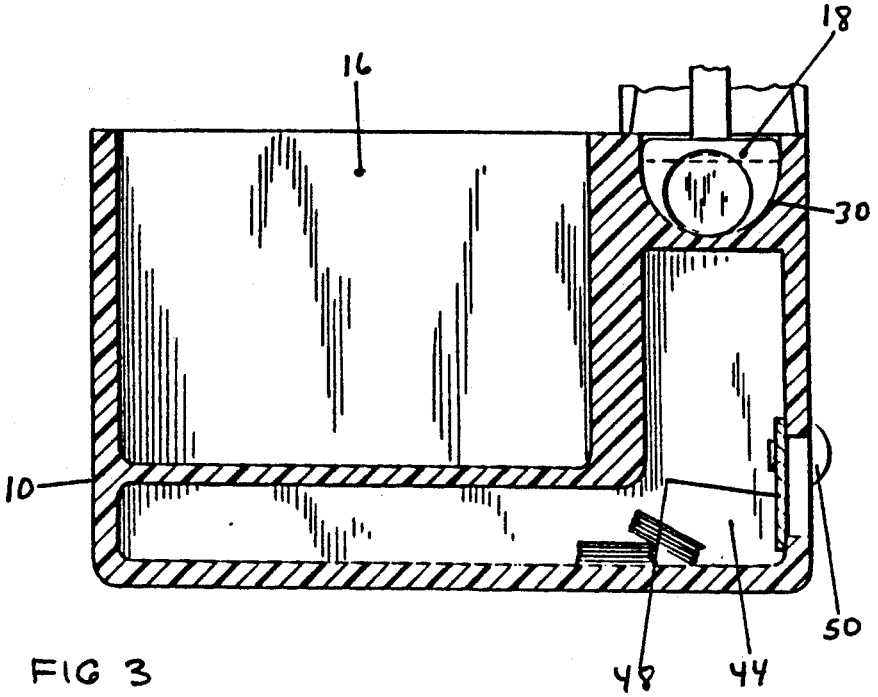
FIG. 3 is a cut away side view of the invention.

The can crusher section 18 of the cooler is the rectangular housing formed by the outer shell and one side of the cooler section. FIG. 2 shows that shape of the opening for the can crusher section is rectangular. FIG. 3 shows a cut away view of the side of the can crusher which shows that the crusher's bottom 30 is semi-circular in construction. The semi-circular piece 30 shown in FIG. 2 only covers a portion of the rectangular opening. There is an opening 42 on one end. FIG. 1 and 3 shows a semi-circular shape ram 30 that is attached to a bar S2. The ram 30 and the bar 32 are hinged together. The ram 30 is slidably mounted within the semi-circular bottom 26. The bar 82 is hingeably attached to the lid 14 of the can crusher. In the preferred embodiment the lid 14 has been reinforced by a plate 38 on which the bar 32 is hingeably attached. Also at the end of the can crusher section 18 opposite from where the can crusher lid 14 is attached, the outer shell 10 has been reinforced by a plate 40.

In operation the lid 16 is opened and a can is placed on the semi-circular bottom 26 between the ram 30 and the outer shell reenforcing plate 40. The lid 14 is then closed. The closing action forces the bar 82 to move the ram 30 towards the outer shells reinforcing plate 40 This action crushes the cans against the outer shell's reinforcing plate 40 as shown in FIG. 2. The can is crushed and the ram 30 moves just past the end of the semi-circular bottom 26. When the lid is again opened and the pressure of the ram 30 is taken from the crushed can, the crushed can, which is now smaller than the opening 42 between the semi-circular bottom and the outer shell's reinforcement plate 40, drops downward due to gravity into bin 44 below bottom of the cooler as shown in FIG. 3. Bin 44 lies between the cooler section and the can crusher section and the outer shell of the invention.

Figure 4:
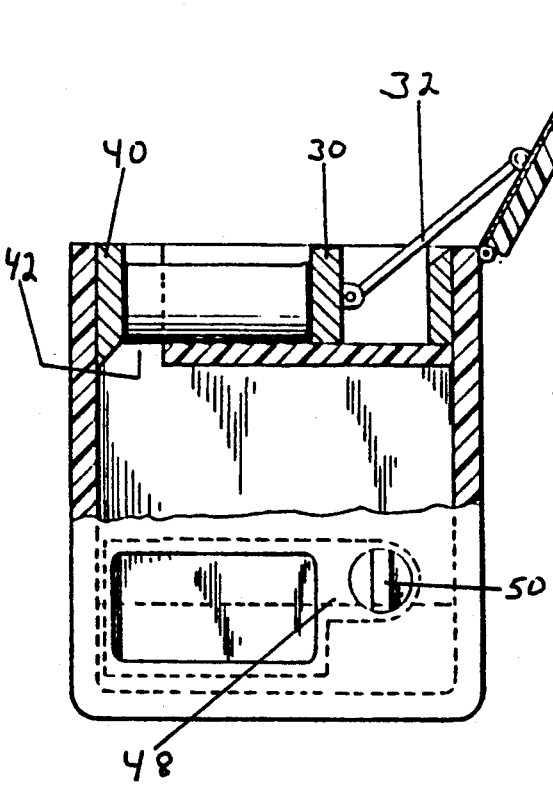
FIG. 4 is an end view of the invention with the can crusher area cut away and the door closed.
Figure 5:
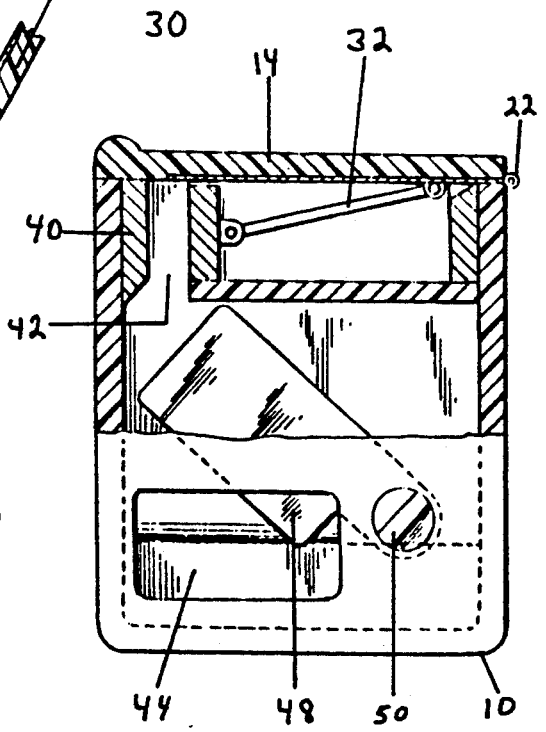
FIG. 5 is the view similar to FIG. 4 only in this figure the door is open.

FIG. 4 and FIG. 5 shows the working of the door on the bin 44. FIG. 4 shows that in the outer shell on the side of the can crusher there is a door 48 and a door handle 50. When the door handle 50 is moved clockwise the door 48 slides upward as shown in FIG. 5. When an individual wishes to remove the crushed cans from the bin 44 he opens the door 48 and dumps the cans. The door 48 is located a little above the bottom of the shell 10. This is done so that liquid which may remain in the discarded can and would leak out into the bin would not seep out the door 48.

The sides, bottom and lid of the cooler section are all formed out of thermal insulated plastic The cooler section 16 could actually be formed out of wood or metal as long as the bottom, sides, and lid are insulated to keep the items within either cold or hot as the owner wishes. The can crusher section 18 and the bin 44 do not need to be insulated.

Changes in modification in the specifically described embodiments can be carried out without departing from the scope of the invention which is intended to be limited only by the scope of the appended claims.

What is claimed is:

1. An environmentally designed portable cooler comprising:

a. a thermally insulated container with a lid; and, b. a manual powered means for crushing cans attached to the thermally insulated container; and, c. a means for storing said cans once crushed by the means for crushing, said means for storage is attached to the means for crushing and the thermally insulated container; and, d. said cooler is adapted to be portable.

2. An environmentally designed cooler as in claim 1 wherein a can once crushed by the means for crushing falls into the means for storing of the crushed cans.

3. A environmentally designed cooler as in claim 2 wherein:

a. the storages means is a bin that is integral attached to the means for crushing and the insulated container whereby when a can is crushed by the means for crushing it will fall through an opening in the means for crushing and into the bin.

4. A environmentally designed cooler as in claim 3 wherein:

a. a door with a bottom that is attached to the bin so that when open the bin can be emptied.

5. An environmentally designed cooler as in claim 4 wherein:

a. the bottom of the door is located on one side above the bottom of the cooler whereby if the crushed can leaked out some of the contents, the content will not easily seep out the door.

6. An environmentally designed cooler comprising:

a. a thermally insulated container with a lid; and, b. a means for crushing cans attached to the thermally insulated container comprising;

1. a rectangular shaped housing integrally attached to the thermally insulated container; and, 2. a semi-circular bottom attached to the rectangle housing with two ends; and, 3. an opening in the semi-circular bottom; and, 4. a ram adapted to be slideably fit within the semi-circular bottom; and, 5. an attaching piece that is integrally attachable to the ram; and, 6. a cover that is hingably attached to the attaching piece and hingeably attached to one end of the rectangle housing; and, c. a means for storing said cans when crushed by the means for crushing, said means for storage is attached to the means for crushing and the thermally insulated container; and, d. whereby a can placed between the ram and the housing, on the end of the housing with the opening and the cover is closed forcing the ram to crush the can against the side of the housing and whereby the ram is designed to crush the can down to a point that the crushed can will fall through the opening and into the means for storing.

7. An environmentally designed cooler as in claim 6 wherein:

a. the means for crushing has been reinforced by an extra plate on the end of the rectangular housing that is opposite the end that the cover attaches to.

8. An environmentally designed cooler as in claim 7 wherein:

a the cover is reinforced by an extra plate to which the attaching piece is hingeably attached.

9. An environmentally designed portable cooler comprising:

a. a thermally insulated container with a lid; and, b. a means for crushing cans attached to the thermally insulated container; and, c. a manual means for powering the means for crushing cans that is portable; and, d. a means for storing said cans once crushed by the means for crushing, said means for storing is attached to the means for crushing and the thermally insulated container; and, e. said cooler is adapted to be portable.

10. An environmentally designed portable cooler as in claim 9 wherein:

a. a can once crushed by the means for crushing falls into the means for storing the crushed cans.

11. An environmentally designed cooler as in claim 9 wherein:

a. the storage means is a bin that is integrally attached to the means for crushing and the insulated container whereby when a can is crushed by the means for crushing it falls through an opening in the means for crushing and into the bin.

12. An environmentally designed cooler as in claim 11 wherein:

a. a door with a bottom that is attached to the bin so that when open, the bin can be emptied.

13. An environmentally designed cooler as in claim 11 wherein:

a. the bottom of the door is located on one side above the bottom of the cooler whereby if a crushed can leaks out some of it contents, the contents will not easily seep out of the door.

* * * * *